United States Patent [19]

Levin et al.

[11] 4,130,381

[45] Dec. 19, 1978

[54] IMPELLER OF AXIAL-FLOW FAN

[76] Inventors: Efim M. Levin, ulitsa Gorkogo, 150, kv. 18; Vladimir P. Sysoev, ulitsa Universitetskaya, 97, kv. 46; Valery A. Rudenko, bulvar Shevchenko, 3, kv. 1; Oleg K. Pomazan, bulvar Pushkina, 31, kv. 11, all of Donetsk, U.S.S.R.

[21] Appl. No.: 804,820

[22] Filed: Jun. 8, 1977

[51] Int. Cl.[2] ..... F04D 29/36

[52] U.S. Cl. ..... 416/196 R; 416/212 R; 416/227 A; 416/231 B

[58] Field of Search ..... 416/227 A, 91, 231 B, 416/198, 212 A, 212 R, 197 A, 196 A, 196 R

[56] References Cited

U.S. PATENT DOCUMENTS

| | | | |
|---|---|---|---|
| 1,345,055 | 6/1920 | Willour | 416/227 A |
| 2,299,592 | 10/1942 | Rober | 416/227 A |
| 2,344,266 | 3/1944 | Reissner | 416/227 A |
| 2,514,487 | 7/1950 | Griese | 416/227 A |
| 2,576,294 | 11/1951 | Geraci | 416/227 A X |
| 3,860,361 | 1/1975 | McMurtry et al. | 416/79 X |

FOREIGN PATENT DOCUMENTS

| | | | |
|---|---|---|---|
| 93963 | 7/1962 | Denmark | 416/198 |
| 992645 | 10/1951 | France | 416/233 |
| 53218 | 5/1967 | Poland | 416/183 |

*Primary Examiner*—Everette A. Powell, Jr.
*Attorney, Agent, or Firm*—Haseltine, Lake & Waters

[57] ABSTRACT

An impeller of an axial-flow fan comprises a hub which carries blades installed thereon with the aid of attachment fittings in the form of a swivelling base with an extension. Each of the swivelling bases supports at least two blades. The distance between the blades installed on a single base varies from 0.15 to 0.3 $\alpha$ where $\alpha$ is the angular distance between the pivots of the adjacent swivelling bases. The blades installed on a single base are rigidly secured thereto at one end and joined to each other by a connector at the other end, thus forming a rigid system.

2 Claims, 2 Drawing Figures

IMPELLER OF AXIAL-FLOW FAN

BACKGROUND OF THE INVENTION

The present invention relates to fans, mainly to axial-flow fans, and more particularly to the impeller of an axial-flow fan.

1. Field Of The Invention

The present invention can be used most successfully in large high-efficiency fans designed, say, for flue gas extraction, for venting mines, in cooling towers and in other cases calling for the creation of powerful gas streams.

2. Prior Art

Known in the prior art is a great number of various designs of impellers of axial-flow fans. Commonly known in current technology are the impellers of axial-flow fans comprising a hub provided with variable-incidence blades arranged at a constant pitch. One of the disadvantages of such an impeller is that it requires the use of blades with a complex profile. In view of insufficient vibration strength of the plate-profile blades, the latter have found little use in axial fan impellers with blades spaced at a constant pitch.

In another design of impellers also known in the prior art the impeller comprises a hub provided with variable-incidence blades spaced at a varying pitch which gradually grows to a certain preset value, then the whole cycle is repeated over again.

In both cases described above, each blade has an individual means for fastening it to the impeller hub.

The hollow impeller blades with a complex profile possess a number of disadvantages; firstly, when the surface of the blades is corroded to the point of development of through holes, this may cause penetration of dust and moisture into the blades, thus putting the impeller out of balance; secondly, such blades are difficult to make and in many cases this requires the use of manual labor; thirdly, the complexity of manufacture raises the cost of such blades; and finally, it is difficult to ensure automatic turning of such blades, because each blade must be turned individually and has an attachment fiting of its own.

SUMMARY OF THE INVENTION

An object of the present invention is to provide an axial-flow fan impeller with blades of a plate profile while the blade-fastening system ensures a high stiffness of said blades.

Another object of the present invention is to provide an axial-flow fan impeller which is simple to manufacture.

Still another object of the present invention consists in a reduction of manufacturing costs involved in making the impeller of an axial-flow fan.

And still another object of the present invention is to simplify the blade turning control system.

These and other objects are accomplished by providing an axial-flow fan impelller comprising a hub and blades connected with the latter by attachment fittings wherein, according to the invention, each attachment fitting is made in the form of a swivelling base with an extension and each of said bases supports at least two rigidly fixed blades which are joined to each other by a connector at their end which is opposite to the base, the blades located on a single base being spaced at a pitch varying from 0.15 to 0.3 $\alpha$ where $\alpha$ is the angular distance between the pivots of the adjacent swivelling bases.

An advantage of the present invention consists in that, owing to the particular fastening of the blades on the hub, it creates an extremely stiff system which, in turn, permits the use of plate-profile blades. This facilitates considerably the blade manufacturing technology and thus cuts down the manufacturing cost. Furthermore, it is obvious that the total number of means for adjusting the position of the blades (their incidence) is decreased at least in half, i.e. proportionally to the number of blades on a single base.

It is expedient that the connector should have an airfoil profile to reduce losses in the space between the blades mounted on a single base.

BRIEF DESCRIPTION OF THE DRAWINGS

Now the invention will be described in detail by way of example with reference to the accompanying drawings, in which.

DETAILED DESCRIPTION OF THE INVENTION

Figure 1:
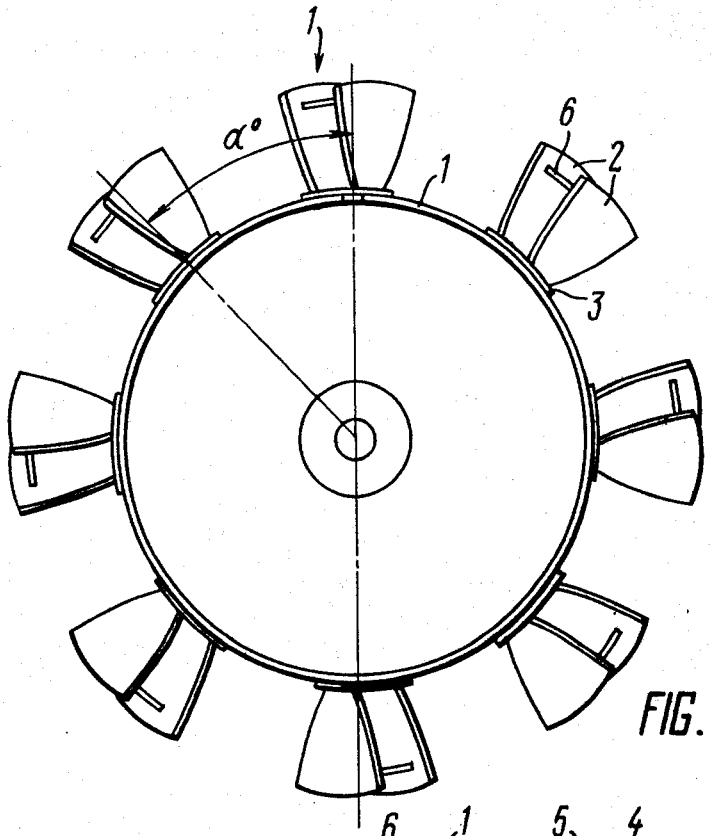
FIG. 1 is a schematic view of the axial-flow fan impeller according to the present invention.
Figure 2:
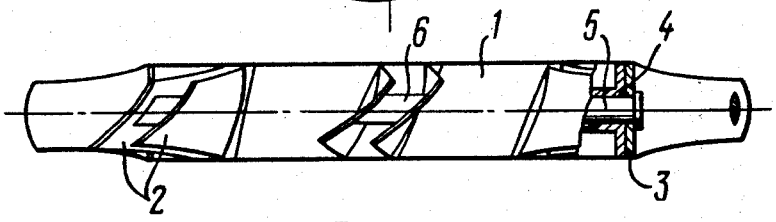
FIG. 2 is a plan view of the impeller shown in FIG. 1, with a partial cutout.

It can be seen in FIG. 1 that the impeller according to the invention comprises a hub 1 with blades 2 fastened thereto by means of swivelling bases 3. To facilitate turning of the bases over the surface of the hub 1, the latter has a hole 4 in its body and the base 3 is provided with an extension 5 passing through said hole and functioning as a turning pivot of the base 3. As shown in FIGS. 1 and 2, each base 3 supports two blades 2 whose lower part is rigidly secured, e.g. by welding, to the base 3 while at their upper part they are rigidly joined to each other by a connector 6 having an airfoil section. In this particular embodiment of the invention, each base supports two blades 2 though the number of said blades may be greater provided the following condition is satisfied.

The substance of this condition consists in that the distance between the blades 2 located on a single base 3 varies from 0.15 to 0.3 $\alpha$ where $\alpha$ is an angular distance between the pivots of the swivelling bases. Bringing the blades together to a distance smaller than 0.15 $\alpha$ inceases sharply the losses in the blade space which eventually reduces the fan efficiency and adversely affects its power characteristics. Conversely, if the blades are spaced apart a distance exceeding 0.3 $\alpha$, this makes it necessary to increase the length of the connectors and bases but it reduces the blade strength because the blades of the axial-flow fans are subjected to very strong centrifugal forces and, due to insufficient vibration strength, they may be destroyed. Besides, it should be noted that an excessive size of the bases limits sharply the adjustment range of the fan because the blades can be turned only within a very small angle.

The design of the impeller according to the present invention permits the use of plate-profile blades, as shown in FIGS. 1 and 2, which simplifies considerably the manufacture of said blades and, as a consequence, of the impeller as a whole.

The axial-flow fan impeller described above can be installed in the axial-flow fan of any known design without modifying its other units such as the inlet guide vanes, flow-straightening vanes, casing, etc.

The operation of the axial-flow fan impeller according to the invention is similar to that of all the currently known impellers and is, therefore, not dealt with in the present description.

While a specific embodiment of the invention has been disclosed in the description, it will be understood that various modifications and changes within the spirit and the scope of the invention may occur to those skilled in the art. Thus, use may be made of special mechanisms for turning the bases. The blades may be of other than the plate profile though they are more difficult to manufacture; furthermore, there may be any number of bases on the impeller hub.

We claim:

1. An axial fan impeller comprising a hub, a plurality of rotatable bases fastened to said hub, a rotatable pivot fastening each said base to the hub, two blades mounted on each said base, said blades being constituted as thin sheets each having one edge fixed to said base, a cross-piece connecting said two blades disposed on the common base in the vicinity of the edges of said blades remote from the edges fixed to the base, said blades being disposed at an angular spacing on said base of from 0.15 $\alpha$ to 0.30 $\alpha$, where $\alpha$ is the angular distance between the pivots of adjacent rotatable bases.

2. An impeller according to claim 1 wherein the connector is of an airfoil section.

* * * * *